United States Patent [19]

Doerfler

[11] 3,985,986

[45] Oct. 12, 1976

[54] DIFFERENTIAL PRESSURE WARNING SWITCH

[75] Inventor: Roger E. Doerfler, Detroit, Mich.

[73] Assignee: Kelsey-Hayes Company, Romulus, Mich.

[22] Filed: Oct. 24, 1974

[21] Appl. No.: 517,508

[52] U.S. Cl. ..... 200/82 D; 200/83 Y; 340/52 C; 251/324

[51] Int. Cl.[2] ..... H01H 35/38; H01H 35/34

[58] Field of Search ..... 200/66, 76–78, 200/243, 275, 277, 282, 291, 82 R, 82 D, 83 J, 83 Y, 83 A, 83 P; 340/52 C, 240; 251/324, 242; 188/1 A, 15 A; 303/6 C; 73/407 R, 407 PR, 419; 116/58 R, 70, DIG. 7, 117 R; 92/49, 50

[56] References Cited

UNITED STATES PATENTS

| | | | |
|---|---|---|---|
| 3,011,595 | 12/1961 | Heiss et al. | 340/52 C |
| 3,187,133 | 6/1965 | Pierce | 200/77 |
| 3,382,333 | 5/1968 | Ihnacik, Jr. | 340/52 C |
| 3,591,051 | 7/1971 | Mitchell | 200/83 J |
| 3,672,732 | 6/1972 | Green | 200/82 D |
| 3,916,129 | 10/1975 | Cadeddu | 200/82 D |

*Primary Examiner*—Gerald P. Tolin
*Attorney, Agent, or Firm*—Harness, Dickey & Pierce

[57] ABSTRACT

A differential pressure warning switch comprising a housing defining a chamber, hydraulic conduits communicating the master cylinder and front and rear fluid brake actuators of an associated vehicular brake system with the chamber, a shuttle piston movable within the chamber between opposed translated positions in response to differential pressure conditions existing between the front and rear brakes of the vehicle, and a pair of pressur responsive flexible diaphragm elements arranged adjacent the opposite ends of the shuttle piston and adapted to effect shuttle movement of the piston in response to predetermined differential pressur conditions in the brake system, whereby to complete an electrical circuit to an associated warning lamp or the like.

16 Claims, 7 Drawing Figures

DIFFERENTIAL PRESSURE WARNING SWITCH

SUMMARY OF THE INVENTION

This invention relates generally to vehicular braking systems and, more particularly, to a new and improved differential pressure warning switch adapted to provide a visual or audio signal to warn a vehicle operator of a failure in either the front or rear brakes of an automobile vehicle provided with a dual braking system.

As will be appreciated by those skilled in the art, it has heretofore been the practice in vehicles having dual brake systems to provide a warning switch responsive to differential fluid pressure conditions between the front and rear brakes of a vehicle in order to apprise the vehicle operator of the occurrence of a failure in the brake systems. In the past, such differential warning switches have utilized sliding pistons having sliding seals adapted for sliding sealing engagement within a machined bore of an associated switch housing. The use of such sliding seals has been found to be objectionable due to the expensive machining required, as well as the close tolerances and concentricities needed to assure for proper operation of the piston.

The present invention provides a new and improved differential pressure warning switch which obviates the need for such sliding seals and accordingly, the need for the expensive and time consuming machining operations needed for prior art switch devices. As will hereinafter be described in detail, the differential pressure warning switch of the present invention is designed so as to utilize a housing which, with the exception of the machining required to mount the fluid fittings to connect the housing with the associated brake system, is entirely devoid of any machining operations. It is accordingly a general object of the present invention to provide a new and improved differential pressure warning switch for use in dual brake systems which minimizes to the extreme the need for expensive machining operations required on similar type switches heretofore known and used.

It is a more particular object of the present invention to provide a new and improved differential pressure warning switch that is of a relatively simple design, that is economical to commercially manufacture and which will have a long and effective operational life.

It is still another object of the present invention to provide a new and improved differential pressure warning switch of the above character which utilizes a pair of deformable or distendable diaphragms for use in effecting shuttling movement of a centrally located piston, the shuttling movement of which function to complete an electrical circuit to an associated warning light or equivalent vehicle operator warning device.

It is still another object of the present invention to provide a new an improved differential pressure warning switch which is of an extremely compact design and hence will find universality of application even where space requirements are limited.

Other objects and advantages of the present invention will become apparent from the following detailed description taken in conjunction with the accompanying drawing.

BRIEF DESCRIPTION OF A PREFERRED EMBODIMENT

Figure 1:
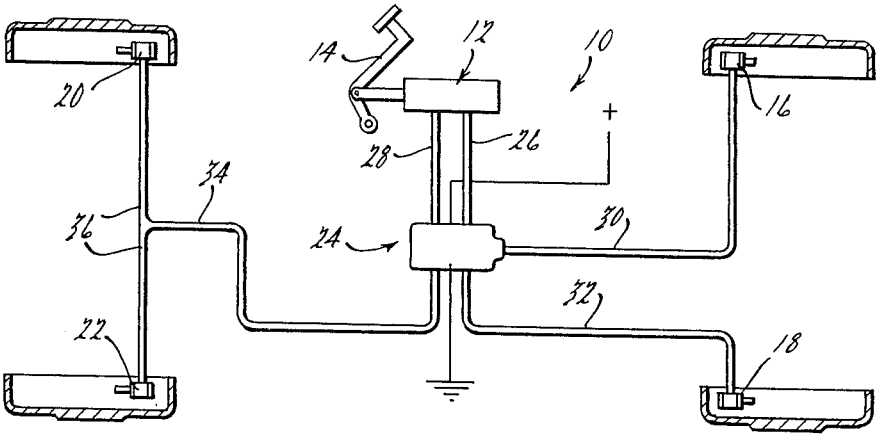
FIG. 1 is a schematic representation of a vehicular brake system having the differential pressure warning switch of the present invention in operative association therewith.

Referring now in detail to the drawing and in particular to FIG. 1 thereof, a vehicular brake system 10 is shown as comprising a split or dual master cylinder 12 adapted to be actuated in a conventional manner by means of a foot operated pedal 14. The brake system 10 comprises a pair of front wheel brakes having front brake actuators 16, 18 and a pair of rear brakes having rear brake actuators 20, 22. In accordance with the principles of the present invention, the brake system 10 is provided with a differential pressure warning switch, generally designated by the numeral 24, which is connected with the master cylinder 12 by means of fluid conduits 26, 28, with the front brake actuators 16, 18 by means of conduits 30, 32, respectively, and with the rear brake actuators 20, 22 by means of fluid conduits 34, 36. As will hereinafter be described in detail, the differential pressure warning switch 24 and functions to sense differential pressure conditions between the front and rear brake actuators and in the event of the failure of one of the brakes, provide a visual or audio signal to the vehicle operator to apprise the operator of such brake malfunction.

Figure 2:
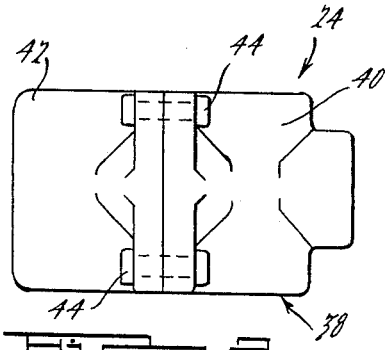
FIG. 2 is a side elevational view of the differential pressure warning switch of the present invention.
Figure 3:
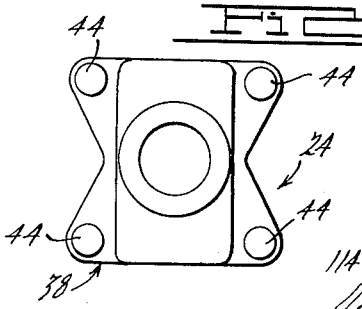
FIG. 3 is an end elevational view of the structure shown in FIG. 2.

Referring now in detail to the construction and operation of the differential pressure warning switch 24 of the present invention, as best seen in FIGS. 2 through 7, the switch 24 includes a switch housing, generally designated by the numeral 38, which is preferably fabricated of a suitable die cast material and consists of a pair of cooperable housing sections 40, 42 that are operatively secured to one another by means of suitable screws, rivets or similar fastening means best seen in FIGS. 2 and 3 and designated by numeral 44. The housing 38 defines a central generally cylindrically shaped chamber 46 which is communicable at the opposite ends thereof via passages 48 and 50 with a pair of cross bores 52 and 54. The bores 52, 54 are formed with counterbored and threaded inlets 56 and 58 which are adapted to be connected via suitable fluid fittings or the like (not shown) with the conduits 26, 28, respectively. The opposite ends of the passages 52, 54 are formed with counterbored and threaded outlets 60 and 62, respectively, which are adapted to be connected via suitable fluid fittings (not shown) with the conduits 32 and 34, respectively. An additional fluid outlet 64 is formed in the housing 38 and is communicable via a passage 66 with the passage 52. As best seen in FIG. 1, the outlet 64 is communicable via a suitable fluid fitting or the like (not shown) with the conduit 30. As a result of the above circuitry, at such time as the brake pedal 14 is actuated, pressurized fluid will be communicated through the conduits 26, 28 and thereafter through the passages 52, 54 to the conduits 32 and 34. Simultaneously, fluid will be communicated via the passage 52, passage 66 and conduit 30, with the result that the brake actuators 16, 18 and 20, 22 will be actuated. As will be apparent, the fluid pressure supplied to the housing 38 will be communicated via the passages 48, 50 into the opposite ends of the chamber 46, for purposes hereinafter to be described.

Figure 4:
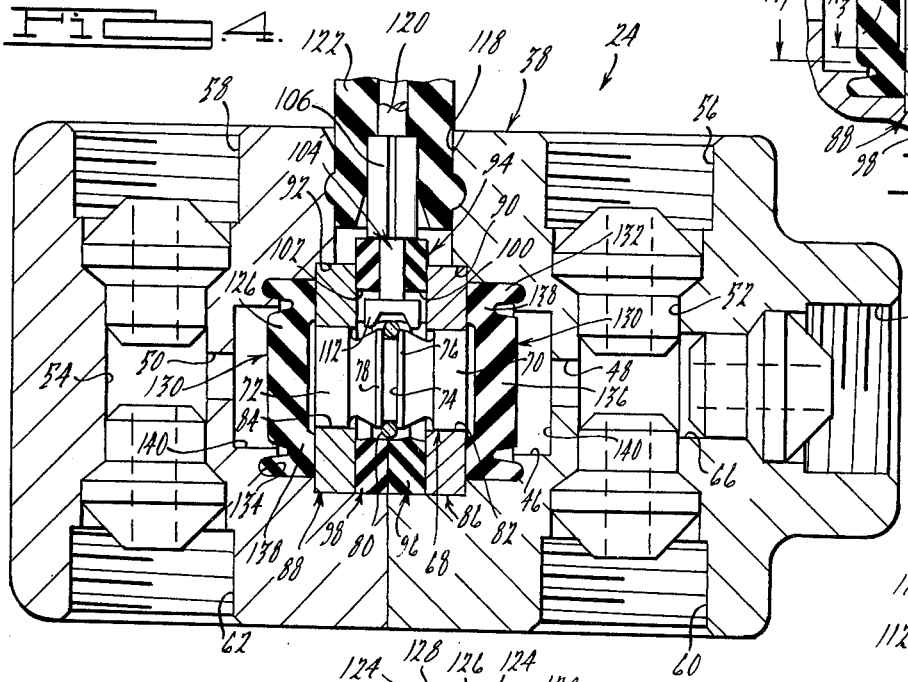
FIG. 4 is an enlarged transverse cross sectional view of the warning switch shown in FIGS. 2 and 3.

Disposed centrally within the chamber 46 is a shuttle piston, generally designated by the numeral 68. As best seen in FIG. 4, the piston is formed with a pair of axially spaced generally cylindrically shaped end portions 70, 72 and with a central annular groove or recess 74 defined between a pair of radially outwardly projecting shoulders 76 and 78. Extending around the piston 68 and partially received within the groove or recess 74 is an annular detent ring 80 which is preferably fabricated of a suitable metallic wire like material. The piston 68 is adapted to shuttle between opposed translated positions and is supported for such shuttling movement by a pair of coaxial bores 82 and 84 defined by a pair of axially spaced washer members 86 and 88 that are located within stepped-shaped counterbores 90 and 92, respectively, in the chamber 46. The bores 82, 84 and cylindrical end portions 70, 72 are dimensioned so as to provide for free sliding movement of the piston 68 without permitting any undesirable relative radial movement therebetween.

Figure 5:
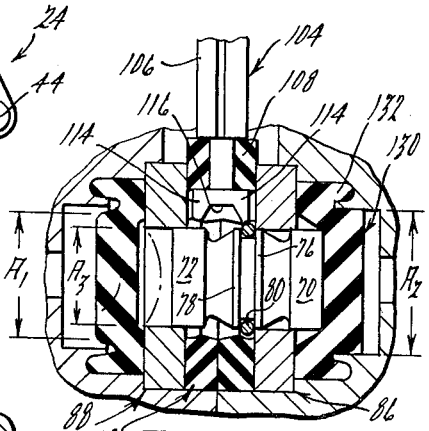
FIG. 5 is a fragmentary cross sectional view of a portion of the switch shown in FIG. 4 after the shuttle piston therein has moved to one of its translated positions.
Figure 6:
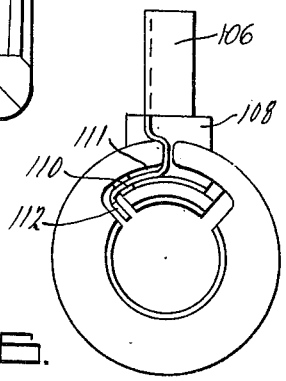
FIG. 6 is a transverse cross sectional view of the differential pressure warning switch of the present invention and discloses the switch terminal therein.

Disposed between the washers 86, 88 and arranged coaxially of the piston 68 is a wafer assembly, generally designated by the numeral 94 and consisting of a pair of adjacently oriented electrically insulative, i.e., non-electrically conductive, wafer elements 96 and 98 which are formed with coaxial bores 100 and 102, respectively. The wafer elements are adapted to operatively support a leaf type contact spring 104 therebetween, and the upper end of the spring 104 is formed with a generally tubular terminal section 106 which, as best seen in FIGS. 5 and 6 is disposed above an upwardly extending boss portion 108 formed in the upper end of the wafer assembly 94. The wafer elements 96, 98 define an internal cavity 110 within which an intermediate section 111 of the spring 104 is disposed, the intermediate section 111 being formed with a generally radially disposed contact end section 112 extending interiorly of the bores 100, 102, as best seen in FIG. 4. As illustrated in FIG. 5, the contact end section 112 is formed with a pair of contact portions 114 which are separated by a relieved or cut-away portion 116, with the contact portions 114 being adapted for contact or engagement with the detent ring 80 in a manner hereinafter to be described. The tubular upper portion of the spring 104 extends upwardly within a bore 118 formed in the housing 38 and is adapted to be connected to a suitable electrical conductor 120. Suitable insulation 122 is provided interjacent the iner periphery of the bore 118 and the spring section 106 in order to electrically insulate the spring 104 from the housing 38. The conductor 120 is intended to be connected to any suitable driver warning device, such as a warning light, buzzer or the like, as is well known in the art.

Figure 7:
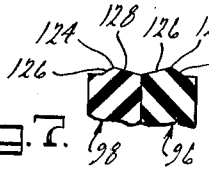
FIG. 7 is an enlarged fragmentary cross sectional view of a portion of the detent means incorporated in the differential pressure warning switch of the present invention.

As best seen in FIG. 7, the periphery of each of the coaxial bores 100 and 102 of the wafer elements 96 and 98 is formed with a radially inwardly projecting ridge 124 defined by inclined converging surfaces 126 and 128. The ridges 124 cooperate with the detent ring 80 in a manner hereinafter to be described for retaining the shuttle piston 68 in its opposed translated positions, with the inclined surfaces 126, 128 functioning to cause the detent ring 80 to compress radially inwardly as the shuttle piston 68 moves from its normal centered position shown in FIG. 4, as will hereinafter be described in detail.

Disposed adjacent each end of the shuttle piston 68 is an annular resilient, deformable diaphragm member 130. The diaphragm members 130, as best seen in FIG. 4, comprise peripheral mounting portions 132 which are adapted to be nestingly received within suitable annular recesses 134 located adjacent the stepped portions 90 of the chamber 46. The diaphragm members 130 also comprise central distendable or deformable portions 136 which are generally axially aligned with the cylindrical portions 70, 72 of the piston 68, with the central portions 136 being connected to the peripheral portions 132 of the diaphragm members 130 by means of reduced thickness flexing portions 138. Disposed between the axially outer sides of each of the diaphragms 130 and the adjacent ends of the passages 48 and 50 are enlarged diameter counterbores 140 which permit the central portions 136 of the diaphragm members 130 to distend or extend axially outwardly upon shuttling of the piston 68 in the direction of the particular diaphragm member 130, as will hereinafter be described in detail in connection with the overall operation of the differential pressure warning switch 24 of the present invention.

As previously mentioned, because of the flexible material and character of the diaphragms 130, the same are adapted to distend or deform axially inwardly and outwardly under the influence of shuttling movement of the piston 68 and pressure conditions within the ends of the chamber 46. More particularly, and as best seen in FIG. 5, at such time as the piston 68 shuttles toward one of the diaphragms 130, the diaphragm will be biased outwardly into the adjacent counterbore 140, as depicted by the right hand diaphragm 130 in FIG. 5. Similarly, at such time as a predetermined pressure condition exists in the axially outer side of one of the diaphragms 130, the diaphragm will be biased inwardly into the associated bore of the adjacent washer 86 or 88, as indicated by the phantom line position of the left hand diaphragm 130 in FIG. 5. It will be noted that during equilibrium conditions at the opposite ends of the chamber 46, the diaphragms 130 present equal areas, designated $A_1$ in FIG. 5, to the fluid pressure within the counterbores 140, and that when one of the diaphragms 130 is biased outwardly into the counterbore 140 under the influence of the shuttling movement of the piston 68, as is the case with the right hand diaphragm 130 in FIG. 5, a second area $A_2$ of such diaphragm 130 is presented to the pressure conditions within the adjacent part of the counterbore 140. Also, when one of the diaphragms 130 is biased under the influence of pressure into the adjacent bore of the adjacent washer 86 or 88, as indicated by the phantom line position of the left hand diaphragm 130, still another area $A_3$, which is smaller than $A_2$, is presented to the pressure conditions within the adjacent counterbore 140.

In operation of the switch 24, assuming that the housing 38 is connected to a suitable electrically grounded portion of the vehicle and that the conductor 120 is connected to a suitable source of electrical energy, the various components of the switch 24 including the shuttle piston 68, detent ring 80 and diaphragms 130 normally assume their respective centered positions shown in FIG. 4. These components remain in this position during operation of the associated vehicle braking system 10 provided that the pressure supplied to the brake actuators 16, 18 and 20, 22 are substantially equal. The reason for this is, of course, that the areas $A_1$ presented by the diaphragms 130 to the pressure supplied to the opposite ends of the chamber 46 are substantially equal and hence the diaphragms 130 and shuttle piston 68 remain in equilibrium. Under these conditions an open circuit exists between the conductor 120 and housing 38. At such time as the pressure supplied to one end of the chamber 46 exceeds the pressure supplied to the other end thereof by a predetermined amount, as would occur when there is a failure in one of the brake actuators or brake conduits, actuation or shuttling of the piston 68 will take place to effect closing of the aforementioned circuit and energization of the associated brake failure warning device. More particularly, assuming, by way of example, that for some reason or another one of the front brakes actuators 16 or 18 failed, the fluid pressure supplied to the left end of the chamber 46 in FIG. 4 would exceed that supplied to the right end thereof. When the differential pressure between the right and left ends of the chamber 46 reaches a predetermined magnitude, the diaphragm 130 at the left end of the chamber 46 will be deformed inwardly, thereby forcing the shuttle piston 68 to shuttle or translate toward the right, i.e., move from the position shown in FIG. 4 to the position shown in FIG. 5. As the piston 68 thus moves to the right, the detent ring 80 will be deformed radially inwardly as the outer periphery thereof slides inwardly along the inclined surface 126 of the wafer element 96. At such time as the detent ring 80 has been compressed radially inwardly sufficiently so that it will pass through the minimum diameter of the wafer element 96 defined by the ridge 124, the stored energy in the ring 80 will tend to cause the ring to expand, with the result that the ring 80 will move further to the right as the outer periphery thereof slides against the radially outwardly inclined surface 128 of the element 96, resulting in the shuttle piston 68 being pulled away from the diaphragm 130 at the left end of the chamber 46. Rightward movement of the piston 68 will continue until the detent ring 80 engages the washer 86, as best seen in FIG. 5. It will be seen that in the shuttled position shown in FIG. 5, the detent ring 80 engages both the washer 86 and one of the contact portions 114 of the spring 104, with the result that a circuit is completed via the conductor 122 to the associated warning device located within the passenger compartment of the associated vehicle so as to apprise the vehicle operator of the failure in the associated brake system.

At such time as the failure condition has been corrected and equal pressures are reintroduced into the opposite ends of the chamber 46 upon actuation of the master cylinder 12, the diaphragm 130 at the left end of the chamber 46 will be distended or deformed axially inwardly into the bore 84 of the washer 88 under the influence of the pressure introduced into the chamber 46 through the passage 50; however, because of the translated or displaced position of the piston 68, the central portion 126 of the left hand diaphragm 130 cannot bear upon the adjacent end of the piston 68, whereas the right end of the piston 68 will be engaged with the central portion 136 of the right hand diaphragm 130, as shown in FIG. 5. Due to the fact that the right hand diaphragm 130 is in its distorted or distended position, the area $A_2$ provided thereby to the pressure supplied to the right hand end of the chamber 46 will be greater than the area $A_3$ of the left hand diaphragm 130 exposed to the pressure supplied to the left end of the chamber 46. Accordingly, at such time as the pressure supplied to the chamber 46 from the master cylinder 12 reaches a predetermined magnitude, the right hand diaphragm 130 will exert sufficient leftwardly directed force upon the piston 68 to cause the same to be biased toward the left or center position. When such force exceeds the retaining force of the detent ring 80, the piston 68 will be shuttled from the position shown in FIG. 5 back to the position shown in FIG. 4, whereupon the piston 68 will rest in its equilibrium position. When this occurs, of course, the detent ring 80 will become disengaged from the spring 104 to open the circuit to the aforementioned warning device and thus effect de-energization thereof. As will be appreciated by those skilled in the art, the reverse of the above-described procedure will occur in the event of a failure in the rear brake system and accordingly a detailed description of the operation of the switch 24 under such conditions will be omitted for purposes of conciseness of description.

While it will be apparent that the preferred embodiment illustrated herein is well calculated to fulfill the objects above stated, it will be appreciated that the present invention is susceptible to modification, variation and change without departing from the scope of the invention.

I claim:

1. A differential pressure warning device comprising a housing defining a chamber, means communicating first and second fluid pressure sources with said chamber, shuttle piston means movable within said chamber between opposed translated positions in response to differential pressure conditions existing between said sources, detent means for retaining said shuttle piston means in said opposed translated positions, said detent means including an annular ring carried on said shuttle piston means, means disposed around the periphery of said chamber adapted for engagement with said annular ring for releasably retaining said shuttle piston means in said opposed translated positions, means for selectively moving said shuttle piston means including first pressure response means exposed to said first fluid pressure source and second pressure response means exposed to said second pressure source, said first and second pressure response means each being movable between a first position, a second position, and a third position and each having a first effective area when in said first position, a second effective area when in said second position, and a third effective area when in said third position said third effective area being smaller than said first effective area and said first effective area being smaller than said second effective area, means responsive to movement of said shuttle piston means for completing an electrical circuit and providing a warning signal.

2. The invention as set forth in claim 1 which includes a pair of spaced washer members slidingly supporting said shuttle piston means within said chamber.

3. The invention as set forth in claim 2 which includes a wafer assembly disposed between said washer members and comprising a pair of adjacently oriented wafer elements defining a bore within which the central portion of said shuttle piston means is disposed, and wherein said bore is formed with radially inwardly projecting ridge means cooperable with said annular ring for retaining said shuttle piston means in said opposed translated positions.

4. The invention as set forth in claim 3 wherein said annular ring is operable when said shuttle piston means moves to said opposed translated positions to complete said electrical circuit between a switch terminal and said housing.

5. A differential pressure warning device comprising, a housing defining a chamber, means communicating first and second fluid pressure sources with said chamber, shuttle piston means normally disposed in a relatively centered position in said chamber and being movable from said center portion toward opposed translated positions in response to differential pressure conditions existing between said sources, means responsive to movement of said shuttle piston means for completing an electrical circuit, and means for selectively moving said shuttle piston means including first pressure response means exposed to the fluid pressure of said first fluid pressure source and second pressure response means exposed to the fluid pressure of said second fluid pressure source.

said first and second pressure response means each being movable between a first position, a second position, and a third position and each having a first effective area when in said first position, a second effective area when in said second position, and a third effective area when in said third position, said third effective area being smaller than said first effective area and said first effective area being smaller than said second effective area, said shuttle piston means being operable as a result of a loss of fluid pressure from one of said fluid pressure sources to distend the adjacent of said pressure response means when said shuttle piston means is moved to one of said translated positions, resulting in said one pressure response means exposing said second effective area to the associated of said pressure sources, said pressure response means opposite said distended pressure response means simultaneously being deformable under the influence of the fluid pressure from the other of said fluid pressure sources to expose said third effective area, whereby an electrical warning signal will be produced when said shuttle piston means is moved to one of said translated positions and whereby said shuttle piston means will be automatically returned to its centered position when normal fluid pressure is restored in said first and second fluid pressure sources.

6. The invention as set forth in claim 5 further including detent means for releasably retaining said shuttle piston means in at least one of said translated positions.

7. The invention as set forth in claim 6 wherein said detent means is operable to exert a radially directed force against said shuttle piston means.

8. The invention as set forth in claim 5 wherein said first and second pressure response means comprise flexible diaphragms.

9. The invention as set forth in claim 5 wherein said first pressure response means is located at one axial end of said shuttle piston means and said second pressure response means is located at the opposite end of said shuttle piston means.

10. The invention as set forth in claim 5 further including switch terminal means fixedly mounted relative to said housing, said means responsive to movement of said shuttle piston means adapted for engagement with said switch terminal means to complete said electrical circuit.

11. The invention as set forth in claim 6 wherein said detent means includes an annular ring carried on said shuttle piston means and means disposed around the periphery of said chamber adapted for engagement with said annular ring for releasably retaining said shuttle piston means in said opposed translated positions.

12. The invention as set forth in claim 11 which includes a pair of spaced washer members slidingly supporting said shuttle piston means within said chamber.

13. The invention as set forth in claim 12 which includes a wafer assembly disposed between said washer members and comprising a pair of adjacently oriented wafer elements defining a bore within which the central portion of said shuttle piston means is disposed, and wherein said bore is formed with radially inwardly projecting ridge means cooperable with said annular ring for retaining said shuttle piston means in said opposed translated positions.

14. The invention as set forth in claim 13 wherein said means responsive to said movement of said shuttle piston means includes a switch terminal, and said annular ring is operable when said shuttle piston means moves to said opposed translated positions to complete said electrical circuit between said switch terminal and said housing.

15. The invention as set forth in claim 5 wherein said first and second fluid pressure sources comprise a dual master cylinder of a vehicle brake system.

16. The invention as set forth in claim 1 wherein said shuttle piston means is operable as a result of a loss of fluid pressure from one of said fluid pressure sources to distend the adjacent of said pressure response means when said shuttle piston means is moved to one of said translated positions, resulting in said one pressure response means exposing said second effective area to the associated of said pressure sources, said pressure response means opposite said distended pressure response means simultaneously being deformable under the influence of the fluid pressure from the other of said fluid pressure sources to expose said third effective area.

* * * * *